US005556470A

United States Patent [19]

Gruber

[11] Patent Number: 5,556,470

[45] Date of Patent: Sep. 17, 1996

[54] SUPPORT FOR A PAINT COATING PAD

[75] Inventor: Gerd Gruber, Feuchtwangan, Germany

[73] Assignee: Rota-Plast Werk Sauer GmbH & Co., Dinkelsbühl, Germany

[21] Appl. No.: 385,558

[22] Filed: Feb. 8, 1995

[30] Foreign Application Priority Data

Feb. 15, 1994 [DE] Germany ..... 9402464 U

[51] Int. Cl.[6] ..... B05C 1/00

[52] U.S. Cl. ..... 118/264; 15/144.1; 15/210.1; 15/209.1; 403/103; 403/97

[58] Field of Search ..... 118/264, 265, 118/109, 504; 15/144.1, 210.1, 209.1; 403/103, 97, 91, 84

[56] References Cited

U.S. PATENT DOCUMENTS

| | | | |
|---|---|---|---|
| 3,795,933 | 3/1974 | Seufert | 15/144.1 |
| 4,219,899 | 9/1980 | Zurawin et al. | 15/210.1 |
| 4,424,603 | 1/1984 | Balint et al. | 15/210.1 |
| 4,517,700 | 5/1985 | Pinto | 15/144.1 |
| 4,658,461 | 4/1987 | Roe et al. | 15/210.1 |
| 4,727,618 | 3/1988 | Mahoney | 15/144.1 |
| 4,819,294 | 4/1989 | Calvert | 15/144.1 |

*Primary Examiner*—Laura Edwards
*Attorney, Agent, or Firm*—James E. Larson

[57] ABSTRACT

A support for a paint coating pad and handle. The support has a base plate for attaching to the paint coating pad. The base plate has a plurality of snap-lock support arms for receiving a shaft of the handle. A latch block having a plurality of locking grooves receives an offset section of the handle permitting the support to be attached to the handle at different working angles.

18 Claims, 2 Drawing Sheets

SUPPORT FOR A PAINT COATING PAD

FIELD OF THE INVENTION

The invention pertains to a coating pad device, in which a base plate carries a coating pad on one side and is provided with projections on the other, to which a handle is removably attached to the base plate at the working angle.

BACKGROUND OF THE INVENTION

In a coating pad device of this type known from practical experience, the projections constitute a sleeve, which is at a slant with respect to the base plate at a fixed, predetermined working angle, and into which an axially oriented end piece of the handle can be pushed and wedged in place. Only the one handle is provided, and it has a fixed, predetermined length. The handle frequently comes loose from the sleeve when least convenient. During use, the predetermined working angle can be a hindrance, because, depending on the orientation of the surface to be coated with respect to the person doing the work, some other working angle may be more convenient. A paint roller device is also known in practice, in which a roller is mounted on a handle, which has a rotating shaft, extending crosswise to the longitudinal direction of the handle, and an offset longitudinal section of the handle, which is connected to the shaft and bent at an angle at one end.

SUMMARY OF THE INVENTION

It is now a task of the invention to create a coating pad device of the general type indicated above, to which, by simple means, a handle can be attached in an adjustable manner so that various working angles can be obtained. To accomplish this task, the coating pad according to the invention is characterized in that a handle is provided with a rotating shaft, extending crosswise to the longitudinal direction of the handle, and with an offset longitudinal section, attached the shaft, one end of which is bent at a certain angle; in that the projections form a pair of snap-lock support arms, between which the rotating shaft is locked in place; and in that, on one side, on a line extending from the rotating shaft, the projections form a latch block, which has several lock grooves into which a part can snap, these grooves extending radially with respect to the rotating shaft at various working angles, and into each of which the offset longitudinal handle section can be locked.

The coating pad device according to the invention is designed in a simplified manner by making use of a handle already known in itself with a rotating shaft and an offset longitudinal section. The invention provides not only for the attachment of this handle to the base plate by means of the rotating shaft and the snap-lock support arms, but also for the fixation of the handle at different working angles by means of the latch block, which is provided with lock grooves. Through the use of this simplified means, the coating pad device can be adapted to the orientation of the surface to be coated, and thus its use can be made more efficient. The snap-lock support arms and the latch block, which are provided as projections, are usually injection-molded of plastic as a single piece with the base plate. The rotating shaft can be pushed in the axial direction between the snap-lock support arms.

It is especially advisable and advantageous to provide a projection on the side of the base plate opposite the latch block to serve as a stop block, against which the rotating shaft can make contact when the offset handle section is outside the locking grooves. With this design, the handle is held in the snap-lock support arms but is also free to rotate in them, which can be convenient in certain practical applications of the coating pad device. Because of the stop block, the handle cannot be pushed unintentionally out of the snap-lock support arms. The stop block is usually injection-molded of plastic as a single piece with the base plate.

It is possible to provide only one pair of snap-lock support arms, which are relatively long in the direction of the base plate. It is especially advisable and advantageous, however, to provide two pairs of snap-lock support arms a certain distance apart. The snap-lock support arms can be kept relatively short in the direction of the base plate, as a result of which a good snap-locking action can be achieved in a simple manner.

It is also especially advisable and advantageous if, in the case of at least one of the locking grooves, at least one of the two walls of the locking groove is formed by a wall piece of reduced length, which is shorter than the piece of the offset handle section held by the latch block. This design simplifies the production of the latch block, especially when the latch grooves are close together and the latch block is injection-molded of plastic.

It is also especially advisable and advantageous for the rotating shaft and the offset part of the handle connected to it to be made of a piece of wire, at the end of which a grip is attached. This is a type of handle which is found frequently in paint roller devices, and its use is therefore especially cost-effective. Because the rotating shaft is formed by a piece of wire, it is relatively thin, which simplifies the design of the snap-lock support arms.

It is especially advisable and advantageous, furthermore, for the base plate to come with a set of handles which are similar but of different lengths. Handles of different lengths are already available in conjunction with paint roller devices and are therefore relatively inexpensive.

The coating pad can be attached to the base plate in any suitable way. It is especially advisable and advantageous, however, for the coating pad to have guide grooves on two opposite sides and for these guide grooves to be pushed over the two side edges of the base plate which are parallel to the rotating shaft. The use of the coating pads with guide grooves already known in themselves further reduces the cost of the production of the coating pad device. The guide grooves make it especially easy to remove and reattach the coating pads. Because coating pads of different designs are used for different coating jobs, it is now possible to attach the coating pad most suitable for the individual coating job and to select the handle of the most suitable length, which can then be attached either with the freedom to rotate or at a suitable working angle.

BRIEF DESCRIPTION OF THE DRAWINGS

The drawing shows a preferred exemplary embodiment of the invention.

DETAILED DESCRIPTION OF THE PREFERRED EMBODIMENT

Figure 1:
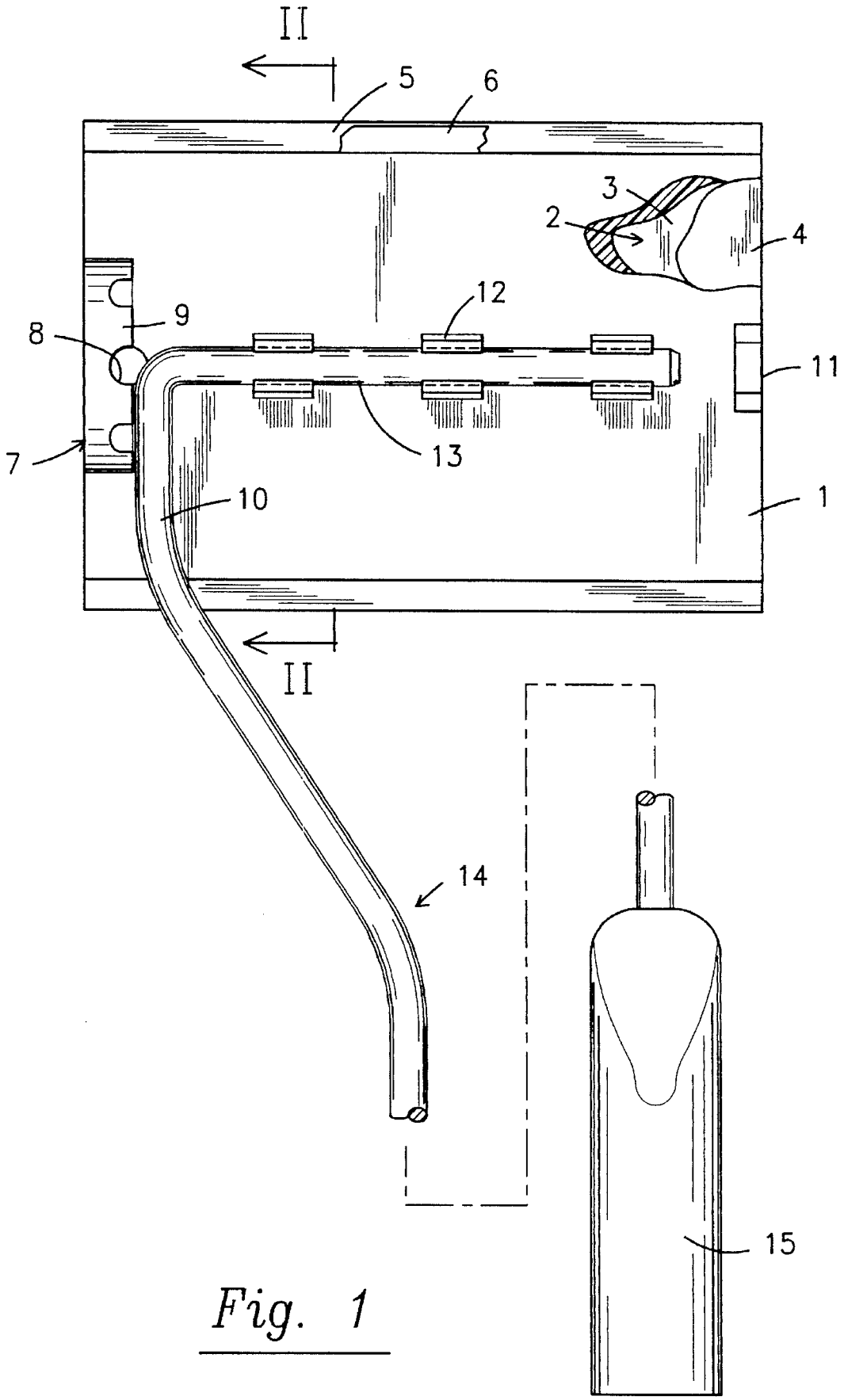
FIG. 1 shows a top view of a coating pad device.

The coating pad device shown in the drawing comprises a rectangular base plate 1, consisting of plastic, which can be rigid and stable. On the bottom of base plate 1, a coating pad 2 is mounted, which comprises a support layer 3 and a layer of padding 4 on the bottom. The pad is bent up and in to form two guide grooves 5, one on each of the two long sides. Guide grooves 5 are pushed over the two long longitudinal side edges 6 of rectangular base plate 1 in the longitudinal direction and thus clamped onto the base plate.

On the narrow side of base plate 1, on the top surface, about in the middle, a latch block 7 is provided, the length of which is approximately equal to half the length of the narrow side. The top of this block is rounded in semicircular fashion. On the inside surface, latch block 7 has three radially oriented locking grooves 8, which meet near base plate 1. Locking groove 8 in the middle is bounded on both sides by a shorted wall piece 9. Each of locking grooves 8 has a cross section which is designed to accept a part of the cross section of offset handle section 10; the cross section narrows down slightly toward the open side of the groove. On the other narrow side of base plate 1, a stop block 11 is provided on the top surface, about in the middle.

Figure 2:
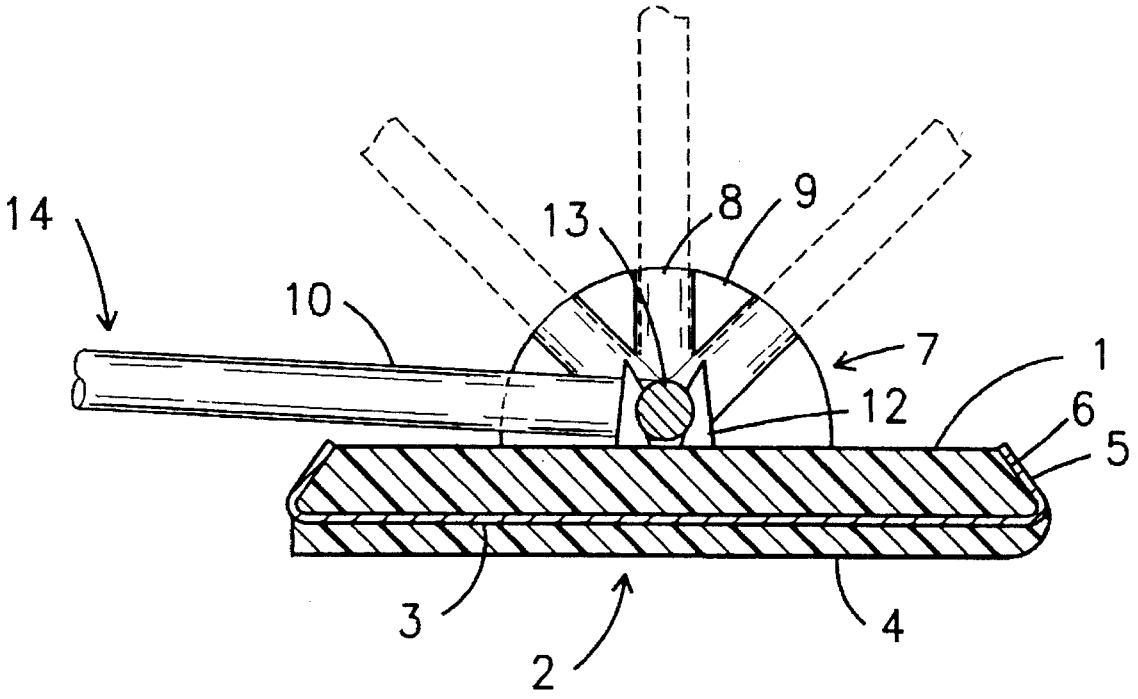
FIG. 2 shows a cross section along line II—II of FIG. 1.

Between stop block 11 and latch block 7 there are, in a line, a certain distance apart, three pairs of snap-lock support arms 12. The two facing sides of a pair of snap-lock support arms 12 form the boundaries of a cross section which is able to accept, at the bottom, a support shaft 13. The cross section then tapers slightly toward the top and then expands conically upward to facilitate the insertion of support shaft 13. The length of support shaft 13 is shorter than the distance between latch block 7 and stop block 11; the support shaft forms a right angle with offset handle section 10. Rotating shaft 13 and the handle connected to it are formed by a wire piece 14 with a round cross section, which carries a grip 15, made of plastic. Offset handle section 10 can, as shown in FIG. 1, be left outside locking grooves 8 or, as indicated in broken line in FIG. 2, it can be snapped into any one of the locking grooves.

I claim:

1. A support for a paint coating pad and a handle, the coating pad having a support layer and a bottom layer for applying coatings to substantially planar surfaces, the handle having a wire piece and a grip, the wire piece having a shaft and an offset section, the support for the paint coating pad and handle comprising, a base plate having top and bottom surfaces, the coating pad support layer juxtaposed to the bottom surface of the base plate when the coating pad is attached to the base plate, a plurality of upwardly extending projections attached along the top surface of the base plate forming pairs of opposed snap-lock support arms, the pairs of opposed snap-lock support arms defining a boundary for receiving the shaft of the wire piece, and a latch block positioned on the top surface of the base plate along a first edge and having a plurality of radially extending locking grooves formed therein for receiving and securing the offset section of the wire piece, the plurality of radially extending locking grooves permitting the handle to be attached to the base plate at a plurality of working angles.

2. The support according to claim 1, further comprising a stop block oppositely positioned from the latch block on the top surface of the base plate along a second edge, the stop block providing a stop against which an end portion of the shaft can make contact with the stop block when the shaft is released from the locking grooves of the latch block.

3. The support according to claim 2, wherein the pairs of opposed snap-lock support arms are in axial alignment positioned intermediate the latch block and stop block.

4. The support according to claim 1, wherein the base plate has a pair of opposed longitudinal side edges for receiving a pair of guide grooves of the coating pad and for clamping the coating pad to the base plate.

5. The support according to claim 1, wherein there are three pair of opposed snap-lock support arms.

6. The support according to claim 1, wherein the latch block has three radially extending locking grooves.

7. The support according to claim 6, wherein the three radially extending locking grooves formed in the latch block are positioned at forty-five, ninety, and one hundred and thirty-five degree angles, respectively, in relation to the top surface of the base plate.

8. The support according to claim 1, wherein the upwardly extending projections are integrally attached to the top surface of the base plate.

9. The support according to claim 1, wherein the latch block is integrally attached to the top surface of the base plate.

10. The support according to claim 1, wherein the base plate is rectangular.

11. A support for a paint coating pad and a handle, the coating pad having a support layer and a bottom layer for applying coatings to substantially planar surfaces, the handle having a wire piece and a grip, the wire piece having a shaft and an offset section, the support for the paint coating pad and handle comprising, a rectangular base plate having top and bottom surfaces, the coating pad support layer juxtaposed to the bottom surface of the base plate when the coating pad is attached to the base plate, a plurality of upwardly extending projections integrally attached along the top surface of the base plate forming pairs of opposed snap-lock support arms, the pairs of opposed snap-lock support arms defining a boundary for receiving the shaft of the wire piece, a latch block integrally attached to the top surface of the base plate along a first edge and having a plurality of radially extending locking grooves formed therein for receiving and securing the offset section of the wire piece, the plurality of radially extending locking grooves permitting the handle to be attached to the base plate at a plurality of working angles, and a stop block oppositely positioned from the latch block and integrally attached to the top surface of the base plate along a second edge, the stop block providing a stop against which an end portion of the shaft can make contact with the stop block when the shaft is released from the locking grooves of the latch block.

12. The support according to claim 11, wherein the pairs of opposed snap-lock support arms are in axial alignment positioned intermediate the latch block and stop block.

13. The support according to claim 11, wherein there are three pair of opposed snap-lock support arms.

14. The support according to claim 11, wherein the latch block has three radially extending locking grooves.

15. The support according to claim 14, wherein the three radially extending locking grooves formed in the latch block are positioned at forty-five, ninety, and one hundred and thirty-five degree angles, respectively, in relation to the top surface of the base plate.

16. A support for a paint coating pad and a handle, the coating pad having a pair of guide grooves, a support layer, and a bottom layer for applying coatings to substantially planar surfaces, the handle having a wire piece and a grip, the wire piece having a shaft and an offset section, the support for the paint coating pad and handle comprising, a rectangular base plate having top and bottom surfaces, a first and second edge, and opposed longitudinal side edges, the coating pad support layer juxtaposed to the bottom surface of the base plate when the coating pad is attached to the base plate, the opposed longitudinal side edges receiving the guide grooves of the coating pad for clamping the coating pad to the base plate, three pair of upwardly extending projections integrally attached to the top surface of the base plate forming three pair of opposed snap-lock support arms, the three pair of opposed snap-lock support arms defining a boundary for receiving the shaft of the wire piece, a latch block integrally attached to the top surface of the base plate along the first edge having three radially extending locking grooves formed therein for receiving and securing the offset section of the wire piece, the three radially extending locking grooves permitting the handle to be attached to the base plate at three different working angles, and a stop block oppositely positioned from the latch block and integrally attached to the top surface of the base plate along the second edge, the stop block providing a stop against which an end portion of the shaft can make contact with the stop block when the shaft is released from the locking grooves of the latch block.

17. The support according to claim 16, wherein the three radially extending locking grooves formed in the latch block are positioned at forty-five, ninety, and one hundred and thirty-five degree angles, respectively, in relation to the top surface of the base plate.

18. The support according to claim 16, wherein the three pair of opposed snap-lock support arms are in axial alignment parallel to the longitudinal side edges of the base plate.

* * * * *